US006595872B2

(12) United States Patent
Yagley et al.

(10) Patent No.: US 6,595,872 B2
(45) **Date of Patent: *Jul. 22, 2003**

(54) GOLF BALL WITH HIGH COEFFICIENT OF RESTITUTION

(75) Inventors: Michael S. Yagley, Cardiff, CA (US); Steven S. Ogg, Carlsbad, CA (US); Pijush K. Dewanjee, Carlsbad, CA (US); David M. Bartels, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/063,861

(22) Filed: May 20, 2002

(65) Prior Publication Data

US 2003/0027665 A1 Feb. 6, 2003

Related U.S. Application Data

(60) Continuation of application No. 09/682,792, filed on Oct. 19, 2001, now Pat. No. 6,478,697, which is a continuation-in-part of application No. 09/877,651, filed on Jun. 8, 2001, now Pat. No. 6,443,858, which is a continuation-in-part of application No. 09/710,591, filed on Nov. 11, 2000, now Pat. No. 6,422,954, which is a division of application No. 09/361,912, filed on Jul. 27, 1999, now Pat. No. 6,190,268.

(51) Int. Cl.[7] ..... A63B 37/04; A63B 37/06; A63B 37/00

(52) U.S. Cl. ..... 473/371; 473/377; 473/351

(58) Field of Search ..... 473/351–377

(56) References Cited

U.S. PATENT DOCUMENTS

| | | | | | |
|---|---|---|---|---|---|
| 5,816,941 | A | * | 10/1998 | Hayashi et al. | 473/359 |
| 5,816,942 | A | * | 10/1998 | Hayashi et al. | 473/359 |
| 5,888,151 | A | * | 3/1999 | Hayashi | 473/363 |
| 6,135,899 | A | * | 10/2000 | Maruko | 473/376 |
| 6,190,268 | B1 | * | 2/2001 | Dewanjee | 473/370 |
| 6,422,954 | B1 | * | 7/2002 | Dewanjee | 473/378 |
| 6,443,858 | B2 | * | 9/2002 | Bartels et al. | 473/351 |
| 6,511,388 | B1 | * | 1/2003 | Dewanjee | 473/377 |

* cited by examiner

*Primary Examiner*—Paul T. Sewell
*Assistant Examiner*—Alvin A. Hunter, Jr.
(74) *Attorney, Agent, or Firm*—Michael A. Catania

(57) ABSTRACT

The present invention is a golf ball that has a coefficient of restitution at 143 feet per second that is greater than 0.8015, and an USGA initial velocity less than 255.0 feet per second. The golf ball is preferably a solid three-piece golf ball with a thermosetting polyurethane cover, an ionomer blend intermediate layer and a polybutadiene core.

19 Claims, 2 Drawing Sheets

GOLF BALL WITH HIGH COEFFICIENT OF RESTITUTION

CROSS REFERENCES TO RELATED APPLICATIONS

The Present Application is a continuation of U.S. patent application Ser. No. 09/682,792 filed on Oct. 9, 2001, now U.S. Pat. No. 6,478,697, which is a continuation-in-part application of U.S. patent application Ser. No. 09/877,651 filed on Jun. 8, 2001, now U.S. Pat. No. 6,443,858, which is a continuation-in-part application of U.S. patent application Ser. No. 09/710,591 filed on Nov. 11, 2000, now U.S. Pat. No. 6,422,954, which is a divisional application of U.S. patent application Ser. No. 09/361,912 filed on Jul. 27, 1999, now U.S. Pat. No. 6,190,268.

FEDERAL RESEARCH STATEMENT

[Not Applicable]

BACKGROUND OF INVENTION

1. Field of the Invention

The present invention relates to a golf ball. More specifically, the present invention relates to a solid three-piece golf ball with a relatively thin cover, a high core compression, a high cover hardness and an initial velocity limited to less than 255 feet per second.

2. Description of the Related Art

The Rules of Golf, as set forth by the United States Golf Association (USGA) and the Royal and Ancient Golf Club of Saint Andrews, have placed controls on the construction and performance of golf balls. The golf ball rules require that the golf ball have a diameter no less than 1.68 inches (42.67 mm), a weight no more than 1.620 ounces avoirdupois (45.93 g), spherical symmetry, an overall distance no greater than 296.8 yards (the limit is 280 yards, or 256 m, plus a six percent tolerance for the total distance of 296.8 yards), and an initial velocity no greater than 255.0 feet per second (the limit is 250 feet or 76.2 m, per second with a two percent maximum tolerance that allows for an initial velocity of 255 feet per second) measured on a USGA approved apparatus.

The initial velocity test is comprised of a large 275 pound wheel that rotates around a central axis at a rate of 143.8 feet per second (striker tangential velocity) and strikes a stationary golf ball resting on a tee. The wheel has a flat plate that protrudes during its final revolution prior to impact with the golf ball. The ball's velocity is then measured via light gates as it travels approximately six feet through an enclosed tunnel. Balls are kept in an incubator at a constant temperature of 23 degrees Celsius for at least three hours before they are tested for initial velocity performance. To test for initial velocity, balls are placed on a tee and hit with the metal striker described above. Twenty-four balls of a particular type make up one test. Each ball is hit with the spinning wheel a total of four times. The highest and lowest recorded velocities are eliminated and the remaining two velocities are averaged to determine the ball speed for that specific ball. The individual speeds of the 24 balls in the group are then averaged, and that is considered the mean initial velocity (IV) of the group for the test.

For USGA conformance purposes, a ball with a mean initial velocity of less than 255.0 feet per second is considered conforming to the USGA Rule of Golf and can be played in sanctioned events. For reference to USGA Wheel Test see USGA web-site at www.usga.com, or reference U.S. Pat. No. 5,682,230 for further information.

Generally speaking, the USGA IV test is designed to be a consistent measurement tool capable of regulating the speed (and ultimately distance) of golf balls. It is commonly known in the industry that golf ball manufacturers perform a simpler test on prototype golf balls and then attempt to correlate the results to the USGA Wheel Test. One type of correlation test is the Coefficient of Restitution (COR) test, which consists of firing a golf ball from a cannon into a fixed plate and taking the ratio of outgoing velocity to incoming velocity.

The Coefficient of Restitution is the ratio of the velocity of separation ($V_{out1}-V_{out2}$) to the velocity of approach ($V_{in1}-V_{in2}$), where $COR=(V_{out1}-V_{our2})/(V_{in1}-V_{in2})$. The value of COR will depend on the shape and material properties of the colliding bodies. In elastic impact, the COR is unity and there is no energy loss. A COR of zero indicates perfectly inelastic or plastic impact, where there is no separation of the bodies after collision and the energy loss is a maximum. In oblique impact, the COR applies only to those components of velocity along the line of impact or normal to the plane of impact. The coefficient of restitution between two materials can be measured by making one body many times larger than the other so that $m_2$ (mass of larger body) is infinitely large in comparison to $m_1$ (mass of the smaller body). The velocity of $m_2$ is unchanged for all practical purposes during impact and $$COR=V_{out}/V_{in}$$

One particular type of COR test device that is commonly used in the golf ball industry is the ADC COR machine developed by Automated Design Corporation. Based on the definition of COR above, $m_2$ is a large 400 lb plate fixed vertically that the ball ($m_1$) is fired into. The impact of golf ball to large fixed plate is an oblique impact. Software developed by Automated Design Corporation accurately calculates the normal velocities given the dimensions of the machine and outputs a value for Coefficient of Restitution as defined above.

U.S. Pat. No. 5,209,485, filed in 1991, discloses a restricted flight golf ball that has a reduced COR. However, the '485 patent also discloses, for comparison purposes, that the TOP FLITE® XL golf balls, manufactured and sold by Spalding had a COR value of 0.813 when fired at a speed of 125 feet per second. The '485 patent also discloses that the Spalding SUPER RANGE golf ball had a COR value of 0.817 when fired at a speed of 125 feet per second. However, the SUPER RANGE golf ball was a non-conforming golf ball and thus had an IV value greater than 255 feet per second.

U.S. Pat. No. 5,803,831, filed in 1996 discloses in Table 14 a finished solid three-piece golf ball that has a COR of 0.784 at a speed of what is believed to be 125 feet per second.

However, the prior art golf balls fail to provide a golf ball that conforms to the USGA IV limit of 255 feet per second while having a high COR.

SUMMARY OF INVENTION

The present invention provides a solution to the problem of adhering to the USGA initial velocity limit of 255 feet per second for a golf ball while increasing the distance a golf ball travels when struck with a golf club. The solution is a solid three-piece golf ball with a high PGA compression core and a thin cover that adheres to the USGA initial velocity limit.

One aspect of the present invention is a golf ball with a core, an intermediate layer, and a cover having a thickness ranging from 0.015 inch to 0.044 inch, wherein the golf ball has a coefficient of restitution at 143 feet per second greater than 0.8015, and an USGA initial velocity less than 255.0 feet per second.

Another aspect of the invention is a golf ball that includes a core composed of a polybutadiene blend, an intermediate layer disposed about the core, a cover disposed over the intermediate layer, and wherein the golf ball has a coefficient of restitution at 143 feet per second greater than 0.7964, and an USGA initial velocity less than 255.0 feet per second. The intermediate layer is composed of a blend of ionomers, and the cover is composed of a thermosetting polyurethane material. The core has a PGA compression ranging from 75 points to 120 points.

Yet another aspect of the present invention is a golf ball that includes a core, an intermediate layer disposed about the core, and a cover disposed over the intermediate layer. The solid core is composed of a polybutadiene blend, has a PGA compression ranging from 90 points to 100 points, and has a diameter ranging from 1.45 inches to 1.55 inches. The intermediate layer is disposed about the core, is composed of a blend of ionomers, has a Shore D hardness ranging from 55 points to 75 points as measured on the curved surface of the intermediate layer, and has a thickness ranging from 0.040 inch to 0.09 inch. The cover is disposed over the intermediate layer, is composed of a thermosetting polyurethane material, and has a thickness ranging from 0.015 inch to 0.044 inch. The golf ball has a coefficient of restitution at 143 feet per second greater than 0.7964, and an USGA initial velocity less than 255.0 feet per second. The golf ball also has a ball Shore D hardness ranging from 50 points to 75 points as measured on the surface of the golf ball.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
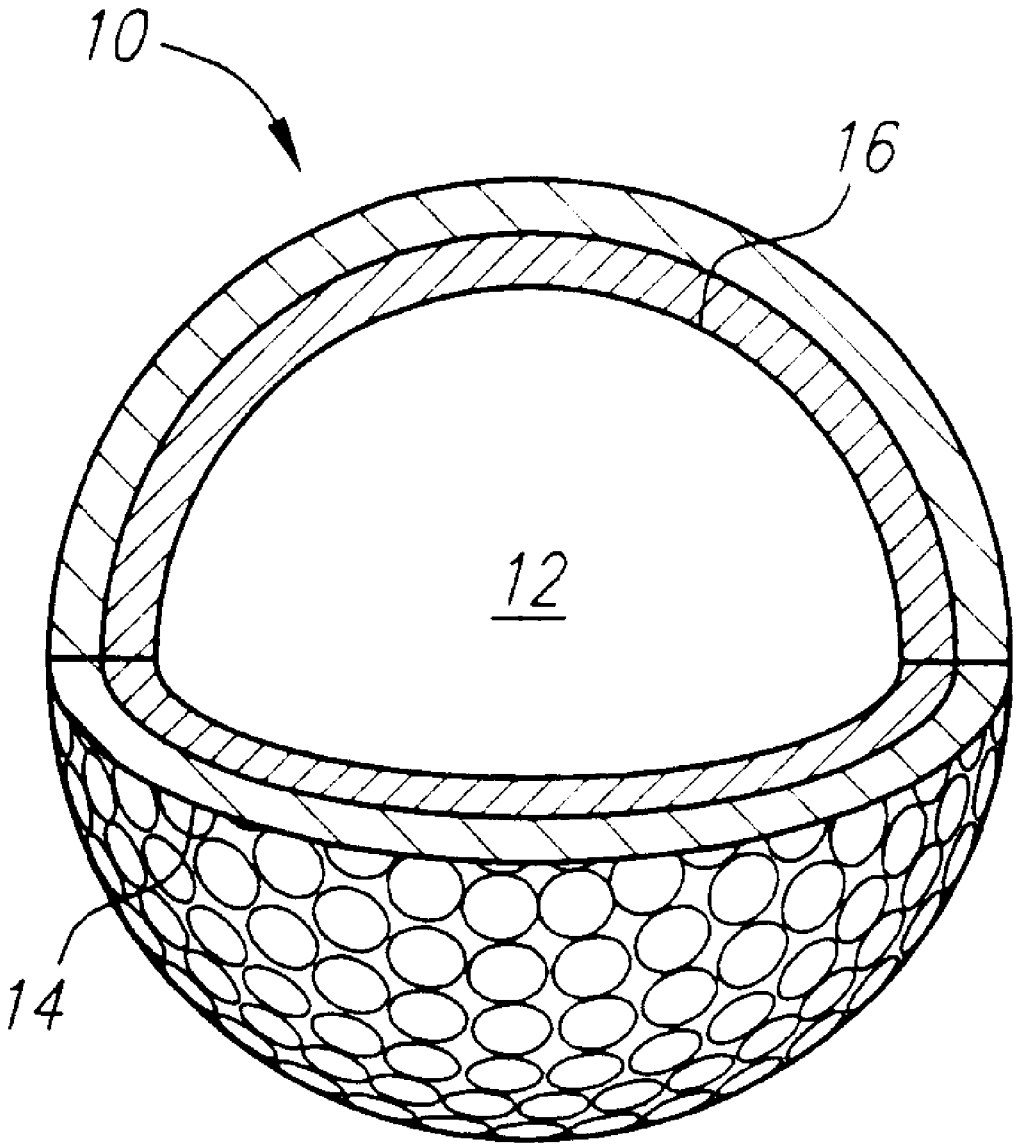
FIG. 1 is a cross-sectional view of a solid three-piece golf ball.

As shown in FIG. 1, a golf ball of the present invention is generally designated 10.

The golf ball 10 has a coefficient of restitution at 143 feet per second greater than 0.7964, and an USGA initial velocity less than 255.0 feet per second. The golf ball of FIG. 1 is a solid three-piece golf ball 10 having a core 12, a cover 14 and an intermediate layer 16. However, those skilled in the pertinent art will recognize that other golf balls may be utilized without departing from the scope and spirit of the present invention.

The surface geometry of the golf ball 10 is preferably a conventional dimple pattern such as disclosed in U.S. Pat. No. 6,224,499 for a Golf Ball With Multiple Sets Of Dimples, which pertinent parts are hereby incorporated by reference. Alternatively, the surface geometry of the golf ball 10 has a non-dimple surface geometry such as disclosed in U.S. Pat. No. 6,290,615, filed on Nov. 18, 1999 for A Golf Ball Having A Tubular Lattice Pattern, which pertinent parts are hereby incorporated by reference.

The golf ball 10 is finished with either a very thin (microns in thickness) single top coating, or is painted with one or more base coats of paint, typically white, before application of a clear coat. The material of the cover 14 may be doped for coloring, as is well known in the art.

The core 12 of the golf ball 10 is the engine for the golf ball 10 such that the inherent properties of the core 12 will strongly determine the initial velocity and distance of the golf ball 10. A higher initial velocity will usually result in a greater overall distance for a golf ball. However, the initial velocity and overall distance of a golf ball must not exceed the USGA and R&A limits in order to conform to the Rules of Golf. Therefore, the core 12 for a USGA approved golf ball is constructed to enable the golf ball 10 to meet, yet not exceed, these limits.

The COR is a measure of the resilience of a golf ball. A golf ball having a COR value closer to 1 will generally correspond to a golf ball having a higher initial velocity and a greater overall distance. In general, a higher compression core will result in a higher COR value.

The core 12 of the golf ball 10 is generally composed of a blend of a base rubber, a cross-linking agent, a free radical initiator, and one or more fillers or processing aids. A preferred base rubber is a polybutadiene having a cis-1,4 content above 90%, and more preferably 98% or above.

The use of cross-linking agents in a polybutadiene core is well known, and metal acrylate salts are examples of such cross-linking agents. Metal salt diacrylates, dimethacrylates, or mono(meth)acrylates are preferred for use in the core 12 of the golf ball 10 of the present invention, and zinc diacrylate is a particularly preferred cross-linking agent. A commercially available suitable zinc diacrylate is SR-416 available from Sartomer Co., Inc., Exton, Pa. Other metal salt di- or mono-(meth)acrylates suitable for use in the present invention include those in which the metal is calcium or magnesium. In the manufacturing process it may be beneficial to pre-mix some cross-linking agent(s), such as zinc diacrylate with the polybutadiene in a master batch prior to blending with other core components.

Free radical initiators are used to promote cross-linking of the base rubber and the cross-linking agent. Suitable free radical initiators for use in the core 12 of the golf ball 10 of the present invention include peroxides such as dicumyl peroxide, bis-(t-butyl peroxy) diisopropyl benzene, t-butyl perbenzoate, di-t-butyl peroxide, 2,5-dimethyl-2,5-di-5-butylperoxy-hexane, 1,1-di (t-butylperoxy) 3,3,5-trimethyl cyclohexane, and the like, all of which are readily commercially available.

Zinc oxide is also preferably included in the core formulation. Zinc oxide may primarily be used as a weight adjusting filler, and is also believed to participate in the cross-linking of the other components of the core (e.g. as a coagent). Additional processing aids such as dispersants and activators may optionally be included. In particular, zinc stearate may be added as a processing aid (e.g. as an activator). Any of a number of specific gravity adjusting fillers may be included to obtain a preferred total weight of the core 12. Examples of such fillers include tungsten and barium sulfate. All such processing aids and fillers are readily commercially available. The present inventors have found a particularly useful tungsten filler is WP102 Tungsten (having a 3 micron particle size) available from Atlantic Equipment, Bergenfield, N.J.

Table One below provides the ranges of materials included in the preferred core formulations of the present invention.

TABLE ONE

| Core Formulation | | |
|---|---|---|
| Component | Preferred Range | Most Preferred Range |
| Polybutadiene | 100 parts | 100 parts |
| Zinc diacrylate | 20–35 phr | 25–30 phr |
| Zinc oxide | 0–50 phr | 5–15 phr |
| Zinc stearate | 0–15 phr | 1–10 phr |
| Peroxide | 0.2–2.5 phr | 0.5–1.5 phr |
| Filler | As desired | As desired |
| (e.g. tungsten) | (2–14 phr) | (10 phr) |

In the present invention, the core components are mixed and compression molded in a conventional manner known to those skilled in the art. The finished core 12 preferably has a diameter of about 1.35 to about 1.64 inches for a golf ball 10 having an outer diameter of 1.68 inches, more preferably a diameter of 1.45 inches to 1.55 inches, and most preferably a diameter ranging from 1.49 inch to 1.515 inch. The core weight is preferably maintained in the range of about 32 grams to about 40 grams. The core PGA compression is preferably maintained in the range of about 75 points to 120 points, most preferably about 90 points to 110 points, and the most preferred is a PGA compression of 90 or 100 points.

As used herein, the term PGA compression is defined as follows

PGA compression value=180 Riehle compression value

The Riehle compression value is the amount of deformation of a golf ball in inches under a static load of 200 pounds, multiplied by 1000.

Accordingly, for a deformation of 0.095 inches under a load of 200 pounds, the Riehle compression value is 95 and the PGA compression value is 85.

In a preferred embodiment, the cover 14 is composed of a thermosetting polyurethane material. Preferably the thermosetting polyurethane material is formed from a blend of polyurethane prepolymers and curing agents such as disclosed in U.S. Pat. No. 6,190,268 which is hereby incorporated by reference in its entirety. However, in an alternative embodiment, the cover 14 is composed of a blend of ionomers, as discussed below in reference to the intermediate layer 16.

The intermediate layer 16 is preferably composed of a thermoplastic material or a blend of thermoplastic materials (e.g. metal containing, non-metal containing or both). Most preferably the intermediate layer 16 is composed of at least one thermoplastic material that contains organic chain molecules and metal ions. The metal ion is sodium, zinc, magnesium, lithium, potassium, cesium, or any polar metal ion that serves as a reversible cross-linking site and results in high levels of resilience and impact resistance. Suitable commercially available thermoplastic materials are ionomers based on ethylene copolymers and containing carboxylic acid groups with metal ions such as described above. The acid levels in such suitable ionomers may be neutralized to control resiliency, impact resistance and other like properties. In addition, other fillers with ionomer carriers may be used to modify the specific gravity of the thermoplastic material blend to adjust the moment of inertia and other like properties. Exemplary commercially available thermoplastic materials suitable for use in an intermediate layer 16 of a golf ball 10 of the present invention include, for example, the following materials and/or blends of the following materials: HYTREL® and/or HYLENE® products from DuPont, Wilmington, Del., PEBAX® products from Elf Atochem, Philadelphia, Pa., SURLYN® products from DuPont, and/or ESCOR® or IOTEK® products from Exxon Chemical, Houston, Tex.

The Shore D hardness of the intermediate layer 16 is preferably 50 to 75. It is preferred that the intermediate layer 16 have a hardness of between about 65–70 Shore D. In a preferred embodiment, the intermediate layer 16 has a Shore D hardness of about 68. It is also preferred that the intermediate layer 16 is composed of a blend of SURLYN® ionomer resins. SURLYN® 8150, 9150, and 6320 are, respectively, an ionomer resin composed of a sodium neutralized ethylene/methacrylic acid, an ionomer resin composed of a zinc neutralized ethylene/methacrylic acid, and an ionomer resin composed of a terpolymer of ethylene, methacrylic acid and n-butyl acrylate partially neutralized with magnesium, all of which are available from DuPont, Polymer Products, Wilmington, Del. It is well known in the art that one may vary the amounts of the different types of resins in order to adjust the hardness of the final material.

The intermediate layer 16 may include a predetermined amount of a baryte mixture. The baryte mixture is included as 8 or 9 parts per hundred parts of the ionomer resins. One preferred baryte mixture is composed of 80% barytes and 20% of an ionomer, and is available from Americhem, Inc., Cuyahoga Falls, Ohio, under the trade designation 38534X1.

A preferred embodiment of the golf ball 10 of the present invention is a solid three-piece golf ball. However, an alternative embodiment has a wound layer between the intermediate layer 16 and the cover 14 such as disclosed in U.S. Pat. No. 6,379,266, filed on Mar. 16, 2000, for a Four Piece Golf Ball, which pertinent parts are hereby incorporated by reference. The core 12 is composed of a polybutadiene blend as described above. The core 12 has a diameter between 1.45 inches and 1.55 inches, and most preferably 1.49 inches. The core 12 has a PGA compression of preferably 90 points or 100 points. The intermediate layer 16 is preferably composed of substantially equal parts of the ionomer resins, SURLYN 8150 and SURLYN 9150, with a range of 40 to 60 parts of SURLYN 8150 to a range of 60 to 40 of SURLYN 9150. The ionomer blend of materials is preferably injection molded over the core to a thickness of between 0.040 inch to 0.080 inch, and most preferably 0.075 inch. The Shore D hardness of the materials of the intermediate layer 16 is preferably between 62 to 75 Shore D as measured according to ASTM D-2290, except the measurement is performed on the curved surface of the intermediate layer 16 by tearing off the cover 14 and using an Instron Shore D Hardness measurement device. The cover 14 is preferably composed of thermosetting polyurethane material, preferably formed from a tri-blend of polyurethane prepolymers and curing agents. The cover 14 is preferably cast over the intermediate layer 16 and core 12, in a casting process such as described in co-pending U.S. patent application Ser. No. 09/496,126 for a System And Method For Forming A Thermoset Golf Ball Cover, filed on Feb. 1, 2000 and hereby incorporated by reference. The cover 14 preferably has a thickness of between 0.015 inch to 0.030 inch, and most preferably 0.020 inch. The Shore D hardness of the golf ball 10, as measured on the golf ball is between 55 Shore D points to 70 Shore D points, and most preferably 65 Shore D points. The hardness of the golf ball 10 is measured using an Instron Shore D Hardness measurement device wherein the golf ball 10 is placed within a holder and the pin is lowered to the surface to measure the hardness. The average of five measurements is used in calculating the ball hardness. The ball hardness is preferably measured on a land area of the cover 14. The surface geometry of the exemplary golf balls 10 of Table Three is preferably 382 dimples arranged as described in U.S. Pat. No. 6,224,499. The overall diameter of the golf ball is approximately 1.68 inches, and the weight is approximately 45.5 grams. Those skilled in the pertinent art will recognize that a golf ball 10 with a larger diameter such as 1.70 inches is within the scope and spirit of the present invention. The preferred golf ball 10 has a COR of approximately 0.8152 at 143 feet per second, and an initial velocity between 250 feet per second to 255 feet per second under USGA initial velocity conditions.

Several golf balls 10 of the present invention were tested for COR against golf balls currently on the market. The balls were kept in an incubator at a constant temperature of 23 degrees Celsius for at least three hours before they were tested for COR performance. To test the COR of a particular ball type, six balls were loaded into a COR machine and fired one at a time through a cannon via compressed air. The test begins by firing the first balls at approximately 80 feet per second, and ends with the last ball firing approximately 180 feet per second. Each of the six balls are fired six times for a combined 48 shots over the range of speeds between 80–180 feet per second.

To determine the COR of a golf ball at any specific incoming velocity, a third-order polynomial curve is fit through the 48 data points and constrained at the origin. This polynomial fit is extremely accurate (with an R^2 fit value greater than 0.999) and allows the COR to be determined at an exact speed of 143 fps without actually having to achieve that specific cannon velocity. The COR is then obtained by plugging in 143 into the third-order polynomial equation and taking the ratio of outgoing velocity to incoming velocity to calculate the coefficient of restitution. For reference to ADC COR machine see Automated Design Corporation web-site at www.automateddesign.com.

TABLE TWO

| Ball | # Covers | # Dimples | Ball Size (inches) | Core Size (inches) | Ball Comp. (PGA) | Shore D Hardness | COR @ 143 fps |
|---|---|---|---|---|---|---|---|
| Callaway Rule 35 Firmfeel | 2 | 382 | 1.680 | 1.515 | 99 | 57 | 0.7782 |
| Callaway Rule 35 Softfeel | 2 | 382 | 1.680 | 1.489 | 90 | 54 | 0.7895 |
| Titleist Pro V1 392 | 2 | 392 | 1.683 | 1.550 | 89 | 63 | 0.7822 |
| Titleist Professional | 1 | 392 | 1.680 | N/A | 93 | 56 | 0.7735 |
| Strata Tour Professional | 2 | 422 | 1.683 | 1.480 | 94 | 46 | 0.7886 |
| Nike Tour Accuracy | 2 | 392 | 1.682 | 1.439 | 90 | 49 | 0.7830 |
| Maxfli Revolution | 1 | 432 | 1.680 | 1.340 | 89 | 54 | 0.7781 |
| Bridgestone B::M | 2 | 432 | 1.682 | 1.287 | 99 | 68 | 0.7964 |
| Titleist HP Tour | 1 | 416 | 1.683 | 1.590 | 83 | 61 | 0.7713 |
| Titleist DT Distance | 1 | 392 | 1.681 | 1.580 | 95 | 70 | 0.7930 |
| Pinnacle Ti Extreme | 1 | 392 | 1.682 | 1.496 | 114 | 68 | 0.7976 |
| Wilson Smart Core Straight Distance | 1 | 432 | 1.679 | 1.509 | 89 | 71 | 0.8001 |
| Top Flite 2000 Extra Long | 1 | 422 | 1.681 | 1.529 | 92 | 72 | 0.7882 |
| Precept MC Spin 392 | 1 | 392 | 1.684 | 1.537 | 85 | 53 | 0.7763 |
| Precept MC Lady | 1 | 432 | 1.681 | 1.515 | 81 | 65 | 0.7960 |
| Slazenger 408dr Raw Distance 3 | 1 | 408 | 1.680 | 1.500 | 106 | 68 | 0.8012 |

Table Two illustrates the results of COR testing of commercially available golf balls. The Callaway Golf RULE 35® golf balls (FIRMFEEL and SOFTFEEL), the Titleist PRO V1 392, Nike TOUR ACCURACY, Spalding STRATA TOUR PROFESSIONAL, and the Bridgestone BIIM, are all solid three-piece golf balls. The Maxfli REVOLUTION and the Titleist PROFESSIONAL are both wound golf balls. The other golf balls are two-piece golf balls. All of the non-two-piece golf balls had a COR below 0.797 at a speed of 143 fps, and all of the golf balls of Table Two had a COR below 0.802 at speed of 143 fps. Only the Callaway Golf RULE 35® golf balls (FIRMFEEL and SOFTFEEL) and the Titleist PRO VI golf balls have a cover thickness below 0.044 inch.

TABLE THREE

| | COR | | | |
|---|---|---|---|---|
| Ball | 80 | 125 | 143 | 180 |
| 1. | 86.59% | 83.26% | 81.53% | 77.26% |
| 2. | 86.22% | 83.19% | 81.51% | 77.23% |
| 3. | 86.54% | 83.55% | 81.94% | 77.9% |
| 4. | 86.26% | 83.34% | 81.81% | 78.02% |
| 5. | 86.31% | 83.03% | 81.34% | 77.22% |
| 6. | 85.62% | 82.68% | 81.15% | 77.33% |
| 7. | 86.41% | 83.16% | 81.59% | 77.9% |
| 8. | 85.9% | 83.% | 81.52% | 77.91% |
| 9. | 86.46% | 83.22% | 81.61% | 77.73% |
| 10. | 85.08% | 80.66% | 78.65% | 74.09% |

Figure 2:
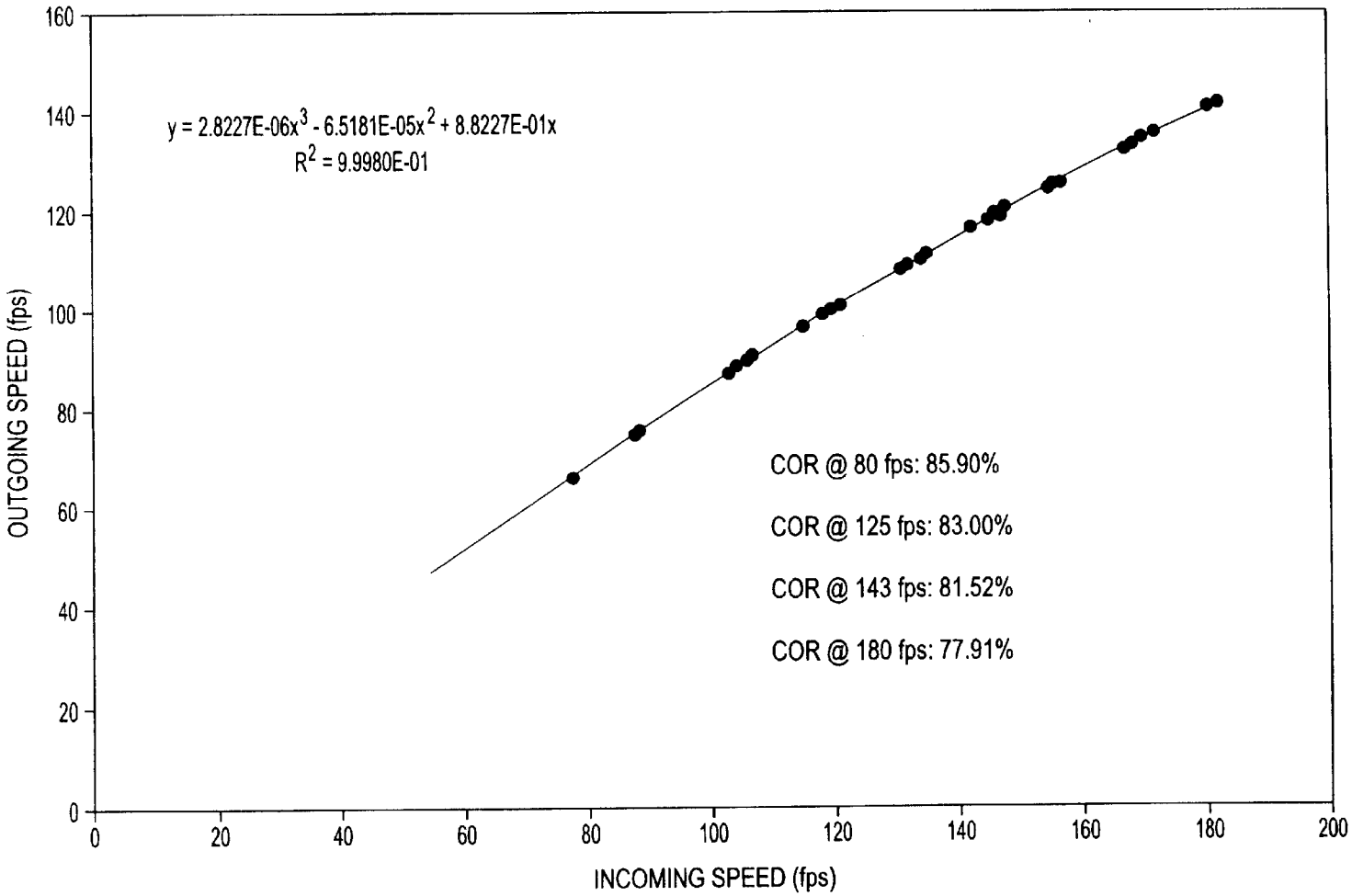
FIG. 2 is a graph of the outgoing speed (y-axis) versus the incoming speed (x-axis) to demonstrate the curve fitting operation for determining the COR of the golf ball of the present invention.

Table Three illustrates the COR calculation of ten exemplary golf balls 10 of the present invention. The four columns are the COR at speeds of 80 feet per second, 125 feet per second, 143 feet per second and 180 feet per second. The COR at 143 feet per second for each of the golf balls 10 of the present invention is at least 0.8115, and most have a COR over 0.815. FIG. 2 illustrates the curve fitting operation that generated the numbers for Table Three.

Table Four illustrates the properties of the ten exemplary golf balls 10 of Table Three. Each of the ten golf balls was composed of a solid polybutadiene core 12, an intermediate layer 16 composed of a blend of ionomers, and a thermosetting polyurethane cover 14 having a thickness of 0.020 inch. The PGA compression of the cores 12 of each of the ten golf balls 10 varied from 90 to 100 points. The diameter of the cores 12 varied from 1.490 inches to 1.515 inches. The thickness of each of the intermediate layers 16 varies from 0.0525 inch to 0.75 inch. The cover material is a cast thermosetting polyurethane (CTPU) and the cover hardness is the hardness of the material measured on a plaque according to ASTM D-2290, as opposed to the ball hardness which is measured on the ball.

TABLE FOUR

| Ball | Core Comp. | Core Diameter | Inter. Thickness | Cover Material | Cover Hardness | Cover Thickness |
|---|---|---|---|---|---|---|
| 1 | 90 | 1.515 | .0625 | CTPU | 45D | 0.020 |
| 2 | 90 | 1.490 | .075 | CTPU | 45D | 0.020 |
| 3 | 100 | 1.515 | .0625 | CTPU | 45D | 0.020 |
| 4 | 100 | 1.490 | .075 | CTPU | 45D | 0.020 |
| 5 | 90 | 1.515 | .0625 | CTPU | 60D | 0.020 |
| 6 | 90 | 1.490 | .075 | CTPU | 60D | 0.020 |
| 7 | 100 | 1.515 | .0625 | CTPU | 60D | 0.020 |
| 8 | 100 | 1.490 | .075 | CTPU | 60D | 0.020 |
| 9 | 90 | 1.490 | .075 | CTPU | 45D | 0.020 |
| 10 | 70 | 1.515 | .0525 | CTPU | 53D | 0.030 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf ball comprising:

a solid core having a PGA compression ranging from 75 points to 120 points, the solid core composed of a polybutadiene blend and having a diameter in the range of 1.35 inches to 1.64 inches;

an intermediate layer disposed about the core; and a cover disposed over the intermediate layer, the cover having a thickness ranging from 0.015 inch to 0.044 inch;

wherein the golf ball has a ball Shore D hardness ranging from 45 points to 75 points as measured on the surface of the golf ball, the golf ball has a coefficient of restitution at 143 feet per second greater than 0.7964, and the golf ball has an USGA initial velocity less than 255.0 feet per second.

2. The golf ball according to claim 1 wherein the intermediate layer has a Shore D hardness ranging from 50 points to 75 points as measured on the curved surface of the intermediate layer.

3. The golf ball according to claim 1 further comprising a thread layer wound around the intermediate layer.

4. The golf ball according to claim 1 wherein the golf ball has a diameter of 1.68 inches to 1.70 inches.

5. The golf ball according to claim 1 wherein the cover is composed of a material selected from the group consisting of thermosetting polyurethane, thermoplastic polyurethane, ionomer, polyether amide, polybutadiene, and any mixture thereof.

6. The golf ball according to claim 1 wherein the golf ball has a ball Shore D hardness of approximately 65 points as measured on the surface of the golf ball.

7. The golf ball according to claim 1 wherein the golf ball has a ball Shore D hardness of approximately 60 points as measured on the surface of the golf ball.

8. The golf ball according to claim 1 wherein the core has a diameter in the range of 1.45 inches to 1.55 inches.

9. The golf ball according to claim 1 wherein the intermediate layer is composed of an ionomer blend of fifty parts of a sodium neutralized high acid methacrylic acid ionomer and fifty parts of a zinc neutralized high acid methacrylic acid.

10. A golf ball comprising:

a solid core composed of a polybutadiene blend and having a PGA compression ranging from 75 points to 120 points;

an intermediate layer disposed about the core, the intermediate having a Shore D hardness ranging from 50 points to 75 points as measured on the curved surface of the intermediate layer;

a cover disposed over the intermediate layer, the cover having a thickness ranging from 0.015 inch to 0.044 inch;

wherein the golf ball has a coefficient of restitution at 143 feet per second greater than 0.7964, and an USGA initial velocity less than 255.0 feet per second, and the golf ball has a ball Shore D hardness ranging from 45 points to 75 points as measured on the surface of the golf ball.

11. The golf ball according to claim 10 wherein the golf ball has a coefficient of restitution at 143 feet per second greater than 0.8015.

12. The golf ball according to claim 10 wherein the golf ball has a coefficient of restitution at 143 feet per second greater than 0.8150.

13. A golf ball comprising:

a solid core composed of a polybutadiene blend, having a PGA compression ranging from 90 points to 120 points, and having a diameter ranging from 1.35 inches to 1.64 inches;

an intermediate layer disposed about the core, the intermediate layer composed of a blend of ionomers, having a Shore D hardness ranging from 50 points to 75 points as measured on the curved surface of the intermediate layer, and the intermediate layer having a thickness ranging from 0.040 inch to 0.09 inch; and a cover disposed over the intermediate layer, the cover composed of a polyurethane material, the cover having a thickness ranging from 0.015 inch to 0.044 inch;

wherein the golf ball has a coefficient of restitution at 143 feet per second greater than 0.7964, and an USGA initial velocity less than 255.0 feet per second, and the golf ball has a ball Shore D hardness ranging from 50 points to 75 points as measured on the surface of the golf ball.

14. The golf ball according to claim 13 wherein the cover has a thickness ranging from 0.020 inch to 0.0375 inch.

15. The golf ball according to claim 13 wherein the cover has a thickness ranging from 0.025 inch to 0.035 inch.

16. The golf ball according to claim 13 wherein the cover has a thickness of 0.030 inch.

17. The golf ball according to claim 13 wherein the core has a PGA compression ranging from 100 to 110 points.

18. The golf ball according to claim 13 wherein the core has a PGA compression of 110 points.

19. The golf ball according to claim 13 wherein the golf ball has a coefficient of restitution at 143 feet per second greater than 0.8150.

* * * * *